US011378052B2

(12) United States Patent
Iwaki

(10) Patent No.: US 11,378,052 B2
(45) Date of Patent: Jul. 5, 2022

(54) IGNITION DEVICE FOR INTERNAL COMBUSTION ENGINE AND CONTROL DEVICE FOR INTERNAL COMBUSTION ENGINE

(71) Applicant: Hitachi Automotive Systems, Ltd., Hitachinaka (JP)

(72) Inventor: Hidefumi Iwaki, Ibaraki (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 0 days.

(21) Appl. No.: 16/767,035

(22) PCT Filed: Nov. 20, 2018

(86) PCT No.: PCT/JP2018/042751
§ 371 (c)(1),
(2) Date: May 26, 2020

(87) PCT Pub. No.: WO2019/102976
PCT Pub. Date: May 31, 2019

(65) Prior Publication Data

US 2020/0318598 A1 Oct. 8, 2020

(30) Foreign Application Priority Data

Nov. 27, 2017 (JP) ..... JP2017-226795

(51) Int. Cl.
*F02P 3/05* (2006.01)
*F02P 15/10* (2006.01)
(Continued)

(52) U.S. Cl.
CPC ..... *F02P 3/05* (2013.01); *F02P 15/10* (2013.01); *F02D 2200/101* (2013.01);
(Continued)

(58) Field of Classification Search
CPC .... F02P 3/05; F02P 3/045; F02P 15/10; F02D 2200/101; F02D 2017/121
See application file for complete search history.

(56) References Cited

U.S. PATENT DOCUMENTS 4,915,087 A * 4/1990 Boyer ..... F02P 15/10 123/643
2013/0226510 A1* 8/2013 Ishii ..... G01D 5/2086 702/150
2015/0034059 A1* 2/2015 Heise ..... F02P 3/0442 123/622

FOREIGN PATENT DOCUMENTS

JP 2012-140924 A 7/2012
JP 2015-200284 A 11/2015
(Continued)

OTHER PUBLICATIONS

International Search Report (PCT/ISA/210) issued in PCT Application No. PCT/JP2018/042751 dated Mar. 19, 2019 with English translation (three (3) pages).
(Continued)

*Primary Examiner* — Logan M Kraft
*Assistant Examiner* — Joshua Campbell
(74) *Attorney, Agent, or Firm* — Crowell & Moring LLP

(57) ABSTRACT

Energization abnormality of a switch element of an internal combustion engine ignition device is detected appropriately. To this end, in an internal combustion engine ignition device that includes an ignition coil and an ignition plug, the ignition coil includes a primary coil including a main primary coil and a sub primary coil and a secondary coil that generates secondary current in response to a voltage variation generated in the primary coil. The internal combustion engine ignition device includes a main switch element that performs energization/deenergization of the main primary coil in a first direction, a sub primary coil magnetic flux
(Continued)

generation state switching unit capable of switching between a forward direction magnetic flux generation state in which energization of the sub primary coil in the first direction is performed and an opposite direction magnetic flux generation state in which energization of the sub primary coil in a second direction is performed, and an abnormality detection section that detects energization abnormality to the sub primary coil. The abnormality detection section is configured so as to detect energization abnormality on the basis of overlap between energization in the first direction and energization in the second direction of the sub primary coil.

10 Claims, 5 Drawing Sheets

(51) Int. Cl.

| | |
|---|---|
| *F02P 3/045* | (2006.01) |
| *F02P 9/00* | (2006.01) |
| *F02P 17/12* | (2006.01) |

(52) U.S. Cl.
CPC ..... *F02P 3/045* (2013.01); *F02P 9/007* (2013.01); *F02P 2017/121* (2013.01); *F02P 2017/125* (2013.01)

(56) References Cited

FOREIGN PATENT DOCUMENTS

| | | | | | |
|---|---|---|---|---|---|
| WO | WO-2016157541 | A1 * | 10/2016 | ..... | F02P 3/00 |
| WO | WO 2017/183062 | A1 | 10/2017 | | |
| WO | WO-2017183062 | A1 * | 10/2017 | ..... | F02P 3/00 |
| WO | WO 2018/083719 | A1 | 5/2018 | | |

OTHER PUBLICATIONS

Japanese-language Written Opinion (PCT/ISA/237) issued in PCT Application No. PCT/JP2018/042751 dated Mar. 19, 2019 (four (4) pages).

* cited by examiner

IGNITION DEVICE FOR INTERNAL COMBUSTION ENGINE AND CONTROL DEVICE FOR INTERNAL COMBUSTION ENGINE

TECHNICAL FIELD

The present invention relates to an ignition device for an internal combustion engine and a control device for an internal combustion engine.

BACKGROUND ART

In recent years, in order to improve the fuel economy and overcome tightened exhaust gas regulations for a vehicle, a technology for operating with mixture leaner than a stoichiometric air-fuel ratio (Lean burn:lean burn) and a technology for taking in part of exhaust gas after combustion to take in air again (Exhaust Gas Recirculation: EGR) have been developed.

In such an internal combustion engine aimed at improving the fuel economy and overcoming tightened exhaust gas regulations as described above, since the amount of fuel or air in a combustion chamber deviates from a theoretical value, ignition failure of fuel by an ignition plug is likely to occur. Therefore, it is necessary to increase the discharge energy of the ignition plug to improve the ignitability.

Patent Document 1 discloses an ignition device in which two ignition coils including a main ignition coil and a sub ignition coil are provided such that outputs of the two ignition coils are superimposed additively to increase the discharge energy of the ignition plug.

PRIOR ART DOCUMENT

Patent Document

Patent Document 1: JP-2012-140924-A

SUMMARY OF THE INVENTION

Problems to be Solved by the Invention

In the ignition device disclosed in Patent Document 1, an ignition plug and a plurality of switch elements for switching the ignition plug ON/OFF are provided and ON/OFF control of an ignition coil by the plurality of switch elements is performed at a predetermined timing such that discharge occurs in the ignition plug.

However, in an ignition device of the type described, there is the possibility that, depending upon the operation state or the ignition timing of the internal combustion engine, ON states of the plurality of switch elements may overlap with each other (overlap). In such a case as just described, since large through-current flows through the ignition device, failure sometimes occurs with the switch elements.

In the past, an ignition device of the type described does not have detection means for detecting energization abnormality of a switch element and cannot detect energization abnormality of a switch element.

Accordingly, the present invention has been made paying attention to the problems described above, and it is an object of the present invention to appropriately detect energization abnormality of a switch element of an ignition device for an internal combustion engine.

Means for Solving the Problems

In order to solve the problems described above, an internal combustion engine ignition device that includes an ignition coil and an ignition plug that performs discharge with current generated in the ignition coil is configured such that the ignition coil includes a primary coil including a main primary coil and a sub primary coil and a secondary coil that generates a voltage according to a current variation generated in the primary coil. The internal combustion engine ignition device includes a main switch that performs energization/deenergization of the main primary coil in a first direction, a sub primary coil magnetic flux generation state switching section capable of switching between a forward direction magnetic flux generation state in which energization of the sub primary coil in the first direction is performed and an opposite direction magnetic flux generation state in which energization of the sub primary coil in a second direction is performed, and an abnormality detection section that detects energization abnormality to the sub primary coil by the sub primary coil magnetic flux generation state switching section, and the abnormality detection section detects energization abnormality to the sub primary coil on the basis of overlap between energization of the sub primary coil in the first direction and energization of the sub primary coil in the second direction.

Advantage of the Invention

According to the present invention, energization abnormality of a switch element of the ignition device for an internal combustion engine can be detected appropriately.

MODES FOR CARRYING OUT THE INVENTION

In the following, an internal combustion engine ignition device 1 according to embodiments of the present invention is described. Although the embodiments are described exemplifying a four-cylinder four-cycle engine as an example of an internal combustion engine, the number or type of cylinders of the internal combustion engine is not limited to this.

Figure 1:
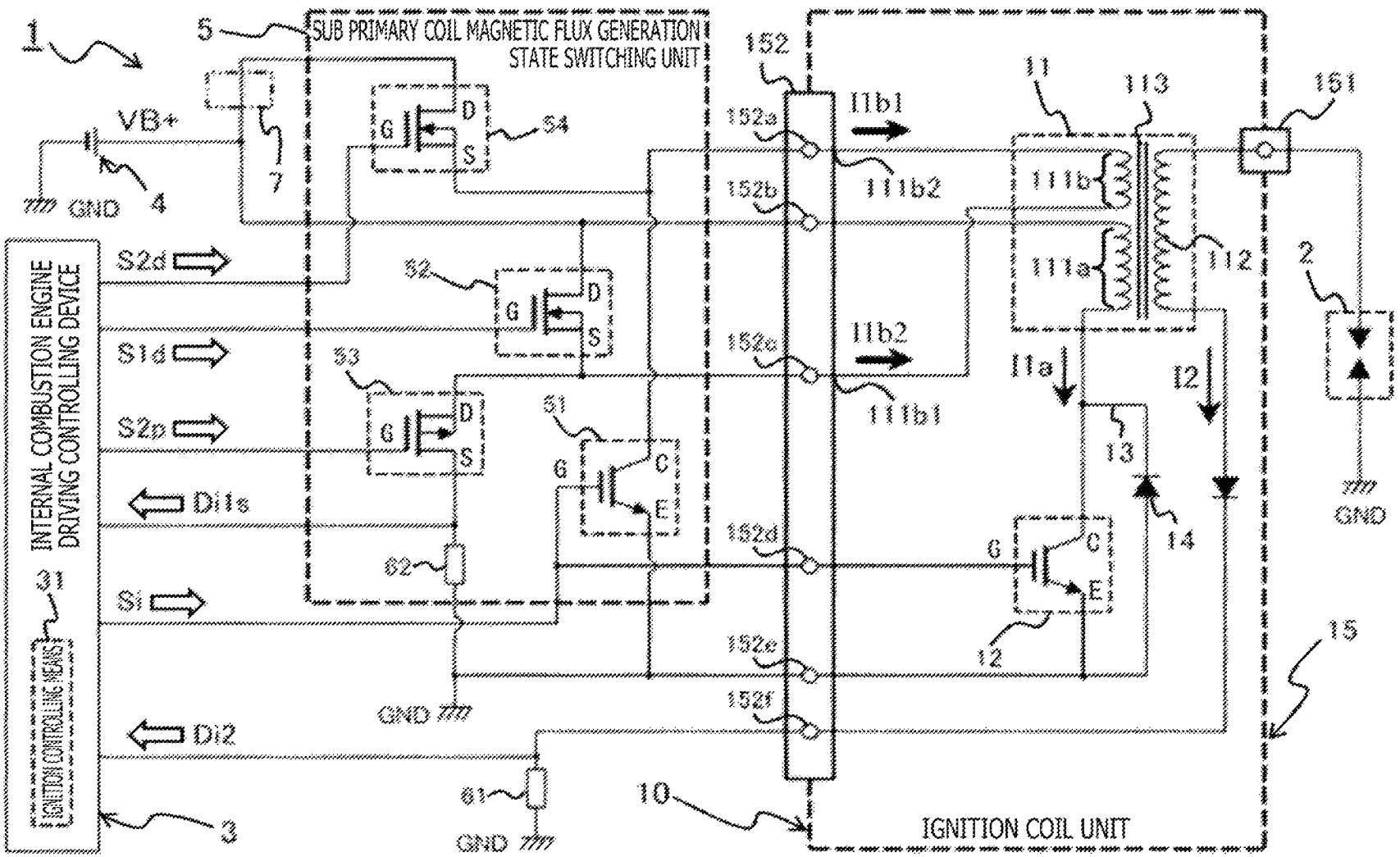
FIG. 1 is an electric circuit diagram illustrating an example of an internal combustion engine ignition device according to an embodiment.

FIG. 1 is an electric circuit diagram illustrating an example of the internal combustion engine ignition device 1.

[Internal Combustion Engine Ignition Device]

As depicted in FIG. 1, the internal combustion engine ignition device 1 includes an ignition coil unit 10 (refer to a broken line in FIG. 1) for causing a discharge spark to be created on one ignition plug 2 provided for each of cylinders of an internal combustion engine (not depicted), an internal combustion engine driving controlling device 3 including ignition controlling means 31 for outputting an ignition signal Si or the like for indicating an operation timing of the ignition coil unit 10 at a suitable timing, a direct current (DC) power supply 4 such as a battery mounted on a vehicle (not depicted), and a sub primary coil magnetic flux generation state switching unit 5.

Although the embodiment is described exemplifying a case in which the ignition controlling means 31 in the internal combustion engine ignition device 1 is included in the internal combustion engine driving controlling device 3 that takes overall control of the internal combustion engine of the vehicle, this is not restrictive. For example, in the internal combustion engine ignition device 1, ignition controlling means that receives an ignition signal generated by an ignition signal generation function an ordinary internal combustion engine driving controlling device has and outputs suitable control signals to the ignition coil unit 10 and the sub primary coil magnetic flux generation state switching unit 5 may be provided separately from the internal combustion engine driving controlling device 3.

[Ignition Coil Unit]

The ignition coil unit 10 is a unit in which an ignition coil 11, a main switch element 12, a bypass line 13 provided in parallel to the main switch element 12, and rectification means 14 provided in the bypass line 13 are accommodated in a case 15 of a required shape so as to have an integral structure.

A high voltage terminal 151 and a connector 152 are provided at suitable locations of the case 15. The connector 152 has a first connection terminal 152*a*, a second connection terminal 152*b*, a third connection terminal 152*c*, a fourth connection terminal 152*d*, a fifth connection terminal 152*e*, and a sixth connection terminal 152*f*.

In the case 15, the ignition plug 2 is connected to the high voltage terminal 151, and the internal combustion engine driving controlling device 3, the DC power supply 4, the sub primary coil magnetic flux generation state switching unit 5, and ground point GND are connected to the first connection terminal 152*a* to the sixth connection terminal 152*f* of the connector 152.

The ignition coil (ignition coil) 11 includes a main primary coil 111*a*, a sub primary coil 111*b*, and a secondary coil 112.

The main primary coil 111*a* is wound, for example, in 90 turns, and the sub primary coil 111*b* is wound, for example, in 60 turns less than those of the main primary coil 111*a*. The main primary coil 111*a* and the sub primary coil 111*b* are wound in a same direction.

The secondary coil 112 is wound in the number of turns (for example, 9000 turns) greater than the total turn number of the main primary coil 111*a* and the sub primary coil 111*b*.

The main primary coil 111*a* and the sub primary coil 111*b* are provided along a longitudinal direction of a center core 113 such that they surround the center core 113, and the secondary coil 112 is provided such that it surrounds the center core 113, the main primary coil 111*a*, and the sub primary coil 111*b* on the outer side of the main primary coil 111*a* and the sub primary coil 111*b*.

Consequently, the ignition coil 11 can allow magnetic fluxes generated by the main primary coil 111*a* and the sub primary coil 111*b* to act upon the secondary coil 112.

The main primary coil 111*a* is connected at one end thereof to the DC power supply 4 through the second connection terminal 152*b*, and a power supply voltage VB+ (for example, 12 V) is applied to the one end. The main primary coil 111*a* is connected at the other end thereof to the ground point GND through the main switch element 12 and the fifth connection terminal 152*e*.

The main switch element (igniter) 12 is switch means for performing energization and deenergization of the main primary coil 111*a*. The main switch element 12 can be formed applying, for example, an insulated gate bipolar transistor (Insulated Gate Bipolar Transistor: IGBT). In particular, the ignition coil unit 10 has a unit structure in which an ignition coil and an igniter are sealed in the case 15.

The main switch element 12 is connected, at a gate terminal G that is a control terminal thereof, to the internal combustion engine driving controlling device 3 through the fourth connection terminal 152*d*, and is ON/OFF controlled on the basis of inputting of an ignition signal Si generated by the ignition controlling means 31.

In the ignition coil unit 10, if the main switch element 12 is switched ON by the ignition signal Si generated by the ignition controlling means 31 and the main primary coil 111*a* is energized, then main primary current I1*a* flows. As a result, magnetic fluxes in the forward direction of the main primary coil 111*a* increase.

In the ignition coil unit 10, if the main switch element 12 is switched OFF and the main primary current I1*a* is interrupted, then magnetic fluxes in the forward direction decrease suddenly, and a high voltage is generated on the secondary coil 112 such that a magnetic field in a direction in which it disturbs this magnetic flux variation is generated.

As a result, a discharge spark is generated between discharge gaps of the ignition plug 2, and secondary current I2 flows through the secondary coil 112. Control for causing the ignition plug 2 to discharge by energization and interruption control of the main primary coil 111*a* in this manner is hereinafter referred to as main ordinary discharge control.

The secondary coil 112 is connected at one end thereof to the ignition plug 2 through the high voltage terminal 151 and is connected at the other end thereof to the ground point GND through the sixth connection terminal 152*f*. It is to be noted that a current detection resistor 61 is provided between the sixth connection terminal 152*f* and the ground point GND such that a secondary current detection signal Di2 is transmitted to the internal combustion engine driving controlling device 3.

[Internal Combustion Engine Driving Controlling Device]

The internal combustion engine driving controlling device 3 can detect an operation situation of the internal combustion engine by supervising the secondary current I2 (secondary current detection signal Di2). The internal combustion engine driving controlling device 3 decides excess or deficiency of discharge energy at each cylinder of the internal combustion engine together with information of the speed and so forth of the internal combustion engine. Then, the internal combustion engine driving controlling device 3 performs such control that, in the case where discharge energy to be provided to the secondary coil 112 is deficient, the discharge energy is increased, but in the case where the discharge energy to be provided to the secondary coil 112 is excessive, the discharge energy is decreased suitably. By the control, a high fuel efficiency improvement effect can be anticipated.

The ignition controlling means 31 of the internal combustion engine driving controlling device 3 performs operation control of the sub primary coil magnetic flux generation state switching unit 5 such that appropriate magnetic fluxes are generated from the sub primary coil 111*b* at an appropriate timing.

Here, the sub primary coil 111*b* in regard to which the direction of energization, energization timing, and deenergization timing are controlled by the sub primary coil magnetic flux generation state switching unit 5 is described.

The sub primary coil 111*b* generates magnetic fluxes in the forward direction by energization (current I1*b*1) in a first direction determined in advance (for example, a direction from a second end 111*b*2 that is one end of the sub primary coil 111*b* to a first end 111*b*1 that is the other end), and generates magnetic fluxes in the opposite direction reverse to the forward direction (magnetic fluxes of a direction same as that of a magnetic field generated on the secondary coil 112 side by the main ordinary discharge control) by energization (current I1*b*2) in the reverse second direction (for example, a direction from the first end 111*b*1 to the second end 111*b*2).

Further, the sub primary coil 111*b* is connected at the first end 111*b*1 thereof to the sub primary coil magnetic flux generation state switching unit 5 through the third connection terminal 152*c*. The sub primary coil 111*b* is connected at the second end 111*b*2 thereof to the sub primary coil magnetic flux generation state switching unit 5 through the first connection terminal 152*a*.

Accordingly, if the sub primary coil magnetic flux generation state switching unit 5 sets the second end 111*b*2 of the sub primary coil 111*b* to the power supply side and sets the first end 111*b*1 to the ground side, then the sub primary coil 111*b* is energized in the first direction. In contrast, if the sub primary coil magnetic flux generation state switching unit 5 sets the first end 111*b*1 of the sub primary coil 111*b* to the power supply side and sets the second end 111*b*2 to the ground side, then the sub primary coil 11*b* is energized in the second direction.

It is to be noted that the first direction and the second direction in the sub primary coil 111*b* depend upon the arrangement state thereof with the main primary coil 111*a*. For example, when the main primary coil 111*a* and the sub primary coil 111*b* are arranged such that the winding direction of the sub primary coil 111*b* and the winding direction of the sub primary coil 111*b* are same, if energization is performed such that the first direction is made same as the energization direction to the main primary coil 111*a*, then magnetic fluxes in the forward direction are generated in the sub primary coil 111*b*. In contrast, when the main primary coil 111*a* and the sub primary coil 111*b* are arranged such that the winding direction of the sub primary coil 111*b* and the winding direction of the main primary coil 111*a* are opposite to each other, if energization is performed such that the first direction is made the opposite direction to that of energization to the main primary coil 111*a*, then magnetic fluxes in the forward direction are generated.

If the sub primary coil 111*b* configured in such a manner as described above is energized in the first direction at a timing same as that of main ordinary discharge control by the main primary coil 111*a* described hereinabove, then magnetic fluxes in the forward direction same as that of the main primary coil 111*a* are generated. Thereafter, if the sub primary coil 111*b* is deenergized at a timing same as that of the main ordinary discharge control, then since magnetic fluxes in the forward direction of both the main primary coil 111*a* and the sub primary coil 111*b* decrease suddenly, the discharge energy to be provided to the secondary side can be increased (refer to secondary current I2 in FIG. 3).

In particular, in the ignition coil 11, if magnetic fluxes in the forward direction are generated by the sub primary coil 111*b* before an ignition timing of the ignition plug 2 (before a deenergization timing to the main primary coil 111*a*) and then interruption of energization of the sub primary coil 111*b* is performed simultaneously with the main primary coil 111*a*, then discharge energy can be provided in an overlapping relationship to the secondary coil 112 by the sub primary coil 111*b*.

Further, in the ignition coil 11, if energization of the sub primary coil 111*b* in the second direction is performed at a suitable timing after the ignition timing of the ignition plug 2 (later than the deenergization timing of the main primary coil 111*a*), then magnetic fluxes in the reverse opposite direction (magnetic fluxes in the same direction as that of a magnetic field by which a high voltage is generated on the secondary coil 112 side), and since the magnetic field on the secondary coil 112 side can be attenuated to suppress decrease of electromotive force on the secondary coil 112 side, the secondary current I2 can be maintained high until interruption of energization of the sub primary coil 111*b* is performed.

In particular, in the ignition coil 11, if magnetic fluxes in the opposite direction are generated by the sub primary coil 111*b* after an ignition timing of the ignition plug 2 such that they act on the secondary coil 112, then discharge energy can be provided in an overlapping relationship to the secondary coil 112 by the sub primary coil 111*b*.

It is to be noted that the timing at which energization of the sub primary coil 111*b* in the second direction is interrupted is a timing at which necessary and sufficient time to maintain the secondary current I2 at high current necessary for suitable combustion in a cylinder elapses, and if energization in the second direction of the sub primary coil 111*b* is continued over a longer period of time, then the fuel economy is rather worsened. Since desirable timings for such energization and deenergization of the sub primary coil 111*b* are not determined to fixed values but vary variously depending upon the structure of the internal combustion engine, characteristics of the ignition coils, operation situation and so forth, it is sufficient if set values or setting information (arithmetic expressions for calculating set values, a comparison table or the like) suitable for the internal combustion engine ignition device 1 is stored into the ignition controlling means 31 of the internal combustion engine driving controlling device 3 in advance.

Further, in the case where energization of the sub primary coil 111*b* in the second direction is interrupted, back electromotive force then acts upon the main primary coil 111*a*. Therefore, a voltage in the opposite direction tending to apply current in the opposite direction to that of ordinary primary current I1 is applied between the collector and the emitter of the main switch element 12, resulting in the possibility that the main switch element 12 may fail or deterioration of the main switch element 12 may be hastened. Therefore, the bypass line 13 is provided in parallel to the main switch element 12, and the rectification means 14 having a forward direction from the ground point GND side toward the ignition coil 11 side of the bypass line 13 (for example, a diode connected at the cathode thereof to the collector side of the main switch element 12 and at the anode thereof to the emitter side of the main switch element 12).

[Sub Primary Coil Magnetic Flux Generation State Switching Unit]

Now, description is given of an example of a configuration of the sub primary coil magnetic flux generation state switching unit 5 that is a sub primary coil magnetic flux generation state switching section capable of switching between a forward direction magnetic flux generation state in which energization of the sub primary coil 111*b* in the first direction is performed and an opposite direction magnetic flux generation state in which energization of the sub primary coil 111*b* in the second direction is performed.

The sub primary coil magnetic flux generation state switching unit 5 includes a first sub switch element 51, a second sub switch element 52, a third sub switch element 53, and a fourth sub switch element 54.

The first sub switch element 51 functions as first sub switch means for switching the second end 111*b*2 side of the sub primary coil 111*b* to the ground point GND such that energization of the sub primary coil 111*b* in the second direction is performed.

For example, the first sub switch element 51 can be configured using an insulated gate bipolar transistor for power control. The first sub switch element 51 is connected at a collector terminal C thereof to the second end 111*b*2 side of the sub primary coil 111*b* through the first connection terminal 152*a* and is connected at an emitter terminal E thereof to the ground point GND side. To the gate terminal G of the first sub switch element 51, an ignition signal Si from the ignition controlling means 31 is inputted. Consequently, if the ignition signal Si is turned ON (for example, the signal level becomes H), then the first sub switch element 51 is turned ON to connect the second end 111*b*2 of the sub primary coil 111*b* to the ground point GND.

The second sub switch element 52 functions as second switch means for allowing power from the DC power supply 4 to the first end 111*b*1 side of the sub primary coil 111*b* such that energization of the sub primary coil 111*b* in the second direction is performed.

For example, the second sub switch element 52 can be configured using a power MOS-FET having a high speed switching characteristic. The second sub switch element 52 is connected at a drain terminal D thereof to the DC power supply 4 side and connected at a source terminal S thereof to the first end 111*b*1 side of the sub primary coil 111*b* through the third connection terminal 152*c*. Further, to the gate terminal G of the second sub switch element 52, a second direction energization instruction signal S1*d* from the ignition controlling means 31 is inputted. Consequently, if the second direction energization instruction signal S1*d* turns ON (for example, the signal level becomes H), then the second sub switch element 52 is turned ON, and the power supply voltage VB+ is applied from the DC power supply 4 to the first end 111*b*1 of the sub primary coil 111*b*.

The third sub switch element 53 functions as third sub switch means for switching the first end 111*b*1 side of the sub primary coil 111*b* to the ground point GND such that energization of the sub primary coil 111*b* in the first direction is performed.

For example, the third sub switch element 53 can be configured using a power MOS-FET having a high speed switching characteristic. The third sub switch element 53 is connected at the drain terminal D thereof to the first end 111*b*1 side of the sub primary coil 111*b* through the third connection terminal 152*c* and connected at the source terminal S thereof to the ground point GND. Further, to the gate terminal G of the third sub switch element 53, a first direction energization permission signal S2*p* is inputted from the ignition controlling means 31. Accordingly, if the first direction energization permission signal S2*p* turns ON (for example, the signal level becomes H), then the third sub switch element 53 is turned ON to connect the first end 111*b*1 of the sub primary coil 111*b* to the ground point GND. It is to be noted that a current detection resistor 62 is provided between the third sub switch element 53 and the ground point GND, and a sub primary current detection signal Di1*s* in the first direction is inputted to the internal combustion engine driving controlling device 3.

The fourth sub switch element 54 functions as fourth sub switch means for allowing power to be supplied from the DC power supply 4 to the second end 111*b*2 side of the sub primary coil 111*b* such that energization of the sub primary coil 111*b* in the first direction can be performed.

For example, the fourth sub switch element 54 can be configured using a power MOS-FET having a high speed switching characteristic. The fourth sub switch element 54 is connected at the drain terminal D thereof to the DC power supply 4 side and connected at the source terminal S thereof to the second end 111*b*2 side of the sub primary coil 111*b* through the first connection terminal 152*a*. To the gate terminal G of the fourth sub switch element 54, a first direction energization instruction signal S2*d* from the ignition controlling means 31 is inputted. Accordingly, if the first direction energization instruction signal S2*d* turns ON (for example, the signal level becomes H), then the fourth sub switch element 54 is turned ON, and the power supply voltage VB+ is applied from the DC power supply 4 to the second end 111*b*2 of the sub primary coil 111*b*.

It is to be noted that, in order to increase the voltage to be applied to the sub primary coil 111*b*, it is not restrictive to use the DC power supply 4 as the power supply means, and a DC power supply of a higher voltage may be used. Alternatively, a boost circuit 7 (indicated by a two-dot chain line in FIG. 1) may be provided to raise the application voltage to the sub primary coil 111*b*.

[Boost Circuit]

Now, an example of a particular configuration of the boost circuit 7 is described.

Figure 2:
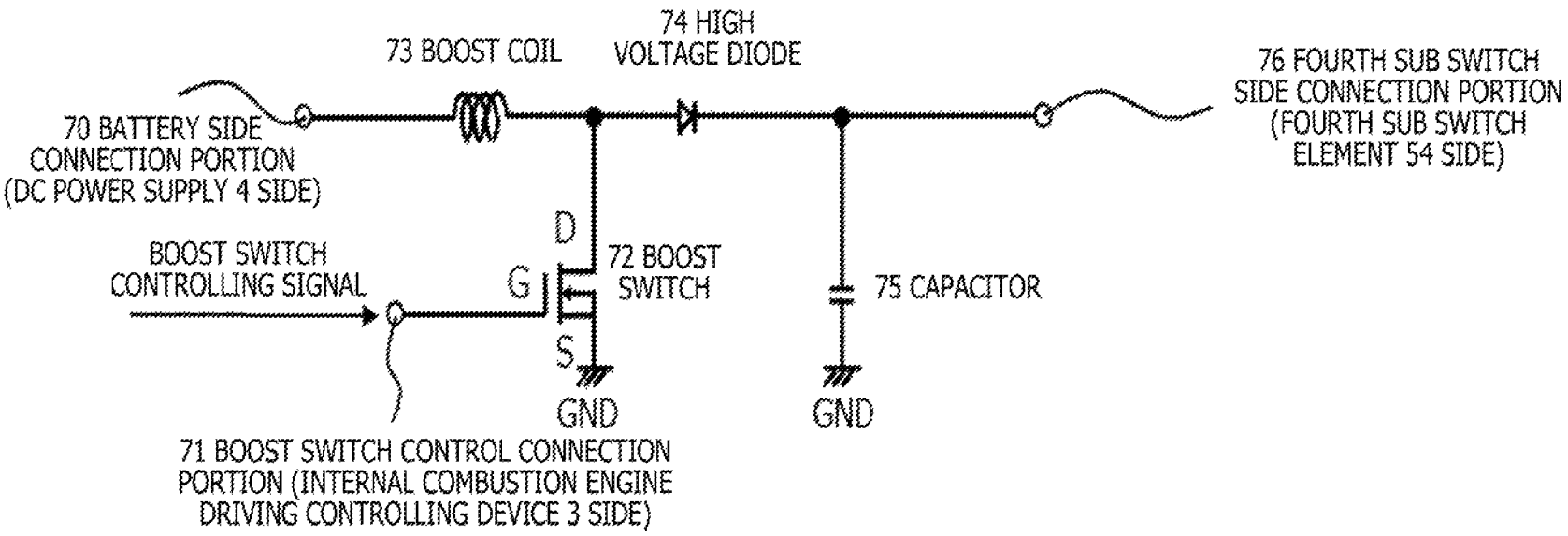
FIG. 2 is an electric circuit diagram illustrating an example of a particular configuration of a boost circuit according to the embodiment.

FIG. 2 is an electric circuit diagram illustrating an example of a particular configuration of the boost circuit 7 according to the embodiment.

The boost circuit 7 includes a boost switch 72, a boost coil 73, a high voltage diode 74, and a capacitor 75. The boost circuit 7 further has a battery side connection portion 70 (terminal) connected to the DC power supply 4 (battery), a boost switch control connection portion 71 (terminal) connected to the internal combustion engine driving controlling device 3, and a fourth sub switch side connection portion 76 (terminal) connected to the fourth sub switch element 54.

The battery side connection portion 70 is connected to the DC power supply 4 (battery), and the power supply voltage VB+ is supplied to the boost circuit 7.

The boost switch 72 can be configured using a power MOS-FET having a high speed switching characteristic. The boost switch 72 is connected at the gate terminal G thereof to the internal combustion engine driving controlling device 3 (refer to FIG. 1) through the boost switch control connection portion 71, at the drain terminal D thereof to one end side of the boost coil 73 and at the source terminal S thereof to the ground point GND.

The boost switch 72 is controlled ON/OFF on the basis of a control signal of the internal combustion engine driving controlling device 3.

The boost coil 73 is connected at one end side thereof to the boost switch 72 such that, when the boost switch 72 is turned ON, current flows therethrough. In the boost coil 73, accumulated energy increases in response to a period of time during which current flows through the boost coil 73. If the boost switch 72 is turned OFF, then this energy is discharged through the high voltage diode and current is charged into the capacitor 75.

Further, the high voltage diode 74 and the capacitor 75 are connected at one end thereof to the fourth sub switch side connection portion 76, and the fourth sub switch side connection portion 76 comes to have a voltage higher than the power supply voltage VB+ of the DC power supply 4.

Meanwhile, the fourth sub switch side connection portion 76 is connected to the fourth sub switch element 54 (refer to FIG. 1) such that, if the fourth sub switch element 54 is turned ON, then a high voltage is applied also to one end (second end 111*b*2) of the sub primary coil 111*b* connected to the first connection terminal 152*a* (refer to FIG. 1).

[Control by Ignition Controlling Means]

Here, an example of control of the ignition controlling means 31 for the sub primary coil magnetic flux generation state switching unit 5 of the structure described above is described with reference to FIG. 3.

Figure 3:
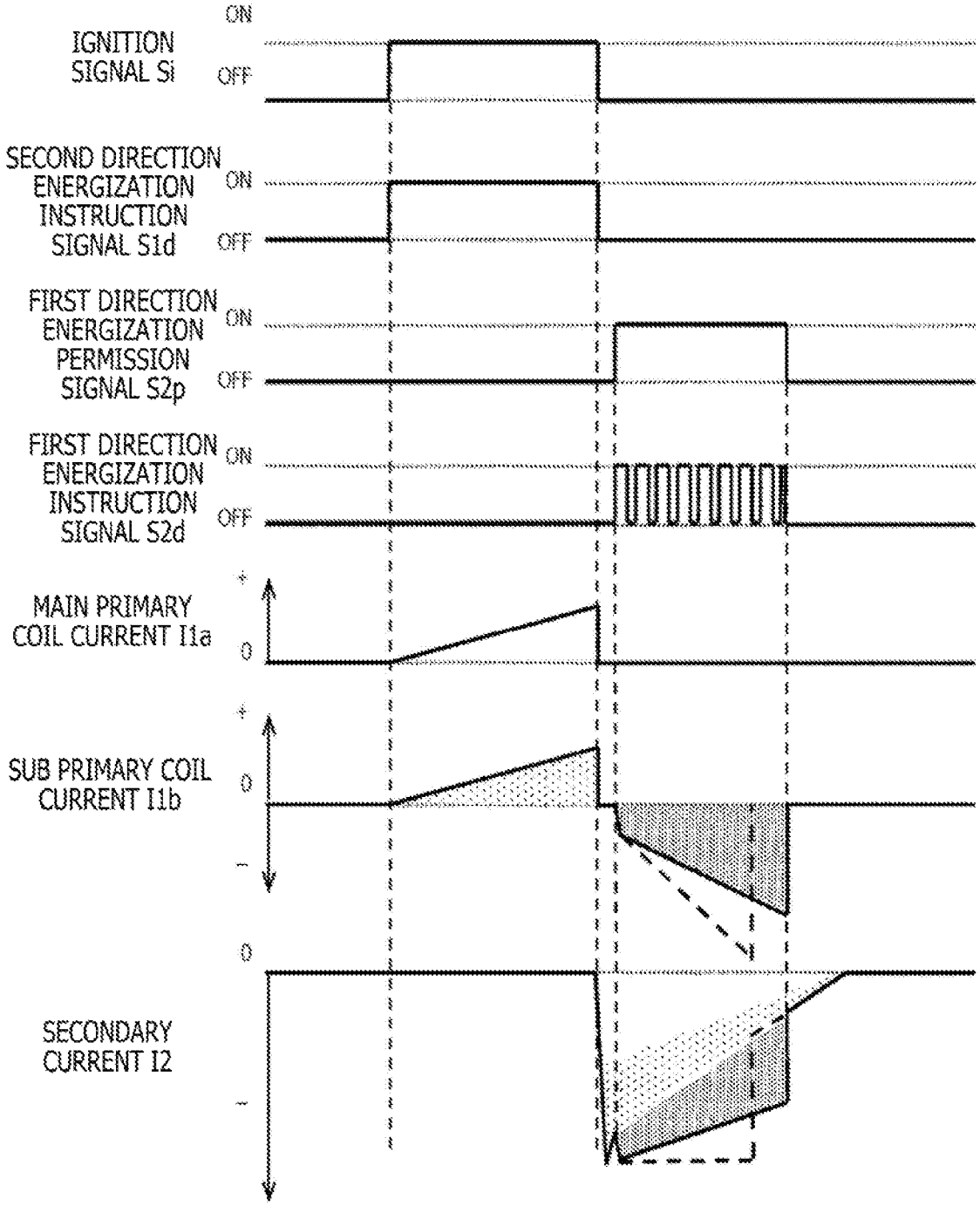
FIG. 3 is a time chart illustrating an example of control by ignition controlling means according to the embodiment.

FIG. 3 is a view illustrating an example of a time charge of the control by the ignition controlling means 31 and depicts a case in which post-ignition timing superimposed discharge control is performed after pre-ignition timing superimposed discharge control is performed. In the control, within one combustion cycle, energy accumulated by both the main primary coil 111*a* and the sub primary coil 111*b* is provided to the secondary coil 112 at once first, and then, energy necessary and sufficient to maintain the induction discharge is provided to the secondary coil 112 from the sub primary coil 111*b*.

In particular, by deenergizing the main primary current I1*a* and the sub primary current I1*b*2 in the first direction simultaneously, discharge energy provided to the secondary coil 112 increases by the amount added by the sub primary coil 111*b* (a portion indicated by thin shading in the sub primary coil waveform in FIG. 3), and the application voltage that causes capacitive discharge by the secondary coil 112 increases as much (indicated by thin shading in the secondary current waveform in FIG. 3). Further, the current applying the sub primary current I1*b*2 in the second direction to the sub primary coil 111*b* (indicated by thick shading in the sub primary coil waveform in FIG. 3) acts on the secondary coil 112, and the secondary current I2 is maintained as the high current (indicated by thick shading in the secondary current waveform in FIG. 3).

In this manner, in the internal combustion engine ignition device 1, by performing the pre-ignition timing superimposed discharge control and the post-ignition timing superimposed discharge control in one combustion cycle, discharge energy higher than that in the case where each of the controls is performed by itself can be provided to the secondary coil 112. Thus, for example, even in a severe operation situation in which the air fuel ratio is high, stabilized in-cylinder combustion can be implemented.

With the internal combustion engine ignition device 1 according to the embodiment described above, main ordinary discharge control, pre-ignition timing superimposed discharge control, post-ignition timing superimposed discharge control, and pre-ignition timing superimposed discharge control+ post-ignition timing superimposed discharge control can be used selectively and properly so as to achieve optimization in response to the operation situation of the internal combustion engine. Therefore, it is possible to optimize the power consumption for ignition to achieve a high fuel economy improving effect.

In addition, although the ignition coil 11 used in the internal combustion engine ignition device 1 includes the main primary coil 111*a* and the sub primary coil 111*b*, it can be configured in a physique (magnitude) similar to that of an existing ignition coil. Accordingly, a plurality of coils or a boost circuit is not required in order to increase the discharge energy to be provided to the secondary coil 112, and it is sufficient if the ignition coil 11 of a physique similar to that of an existing ignition coil is used. Therefore, increase in size of an ignition coil and significant increase of the cost can be suppressed.

It is to be noted that, while the internal combustion engine ignition device 1 according to the present embodiment is configured such that the functions for controlling the energization direction and the energization and deenergization of the sub primary coil 111*b*, namely, the first to fourth sub switch elements 51 to 54, are unitized as the sub primary coil magnetic flux generation state switching unit 5, this is not restrictive. For example, since the first sub switch element 51 of the sub primary coil magnetic flux generation state switching unit 5 is turned ON/OFF in synchronism with the main switch element 12 by the ignition signal Si, in order to simplify the signal path for the ignition signal Si, it is conceivable to place the main switch element 12 and the first sub switch element 51 in close proximity to each other.

Further, although all of FIGS. 1 to 3 depict one cylinder, in the case of an internal combustion engine configured from a plurality of cylinders, the boost switch 72, the second sub switch element 52, and the fourth sub switch element 54 may be made common to the cylinders while the main switch element 12, the first sub switch element 51, and the third sub switch element 53 are provided for each of the cylinders and all of the components are placed into a single case to form a supervisory unit to which the ignition coil units 10 of the cylinders are connected.

A control method for each switch configured in this manner is described with reference to FIG. 4.

Figure 4:
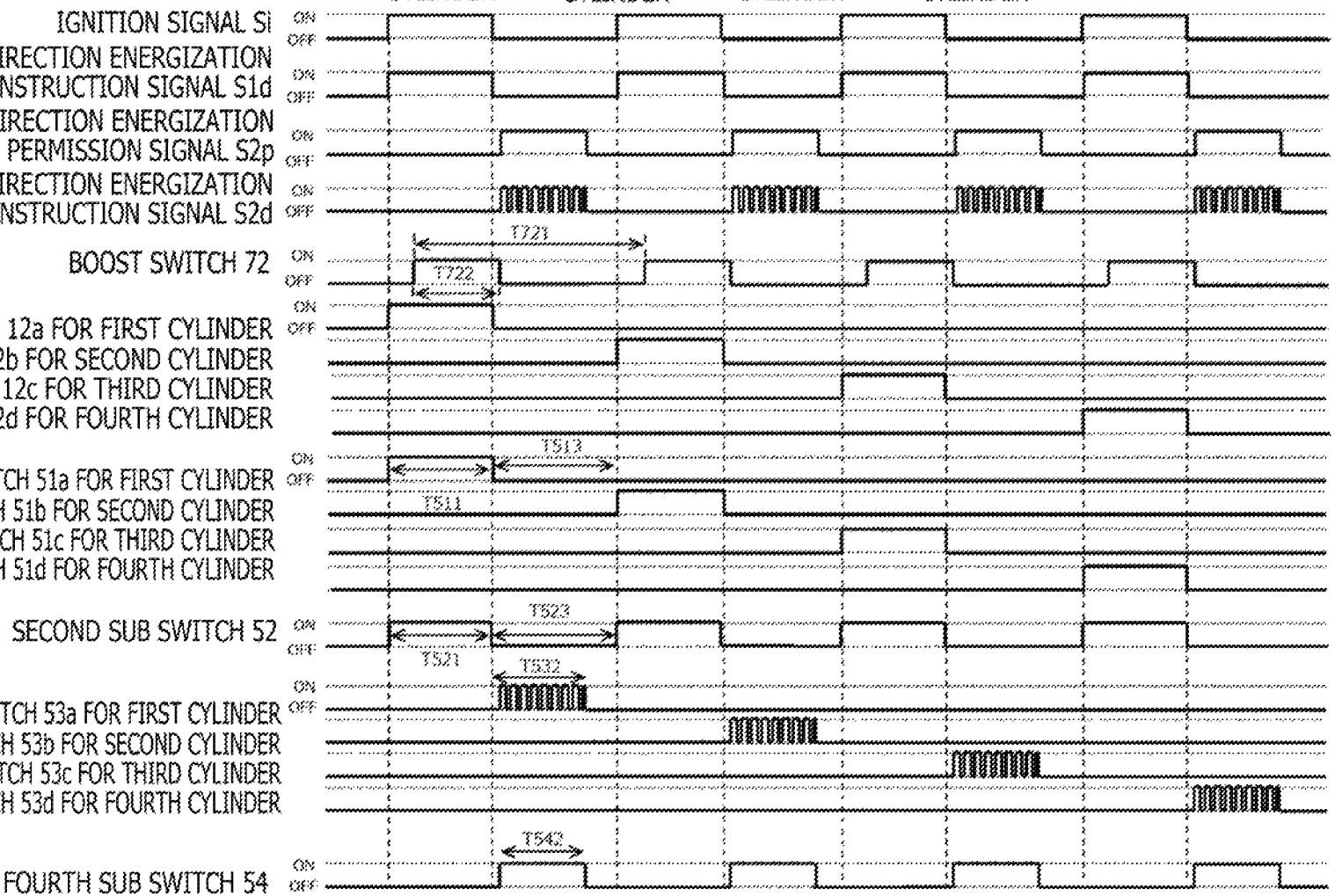
FIG. 4 is a time chart illustrating an example of control of the internal combustion engine ignition device in the case where the internal combustion engine is a four-cylinder internal combustion engine.

FIG. 4 is a time chart illustrating a control method for the internal combustion engine ignition device 1 in the case where an internal combustion engine has four cylinders (first to fourth cylinders).

The boost switch 72, the second sub switch element 52, and the fourth sub switch element 54 are controlled in common with the cylinders, and the main switch element 12 is provided for each of the cylinders (12*a* to 12*d*); the first sub switch element 51 is provided for each of the cylinders (51*a* to 51*d*); and the third sub switch element 53 is provided for each of the cylinders (53*a* to 53*d*).

In the internal combustion engine ignition device 1, at the time of pre-ignition timing superimposed discharge control of the first cylinder, the ignition signal Si is turned ON at an energization timing of the first cylinder, and the second direction energization instruction signal S1*d* is synchronously turned ON and the main switch first cylinder 12*a* is synchronously turned ON. Further, the first sub switch first cylinder switch 51*a* and the second sub switch element 52 are turned ON synchronously.

Then, in the internal combustion engine ignition device 1, at the time of post-ignition timing superimposed discharge control, the first direction energization permission signal S2*p* is turned ON, and the first direction energization instruction signal S2*d* is PWM controlled synchronously. Further, the third sub switch first cylinder 53*a* is PWM controlled synchronously. Further, the fourth sub switch element 54 is turned ON simultaneously.

The boost switch 72 is turned ON before time at which the first direction energization instruction signal S2*d* is turned ON in order to assure high current (in order to charge the boost coil 73).

Although description is omitted, also the second cylinder, the third cylinder, and the fourth cylinder operate similarly.

[Functional Configuration of Internal Combustion Engine Driving Controlling Device]

A functional configuration of the internal combustion engine driving controlling device 3 described above is described.

Figure 5:
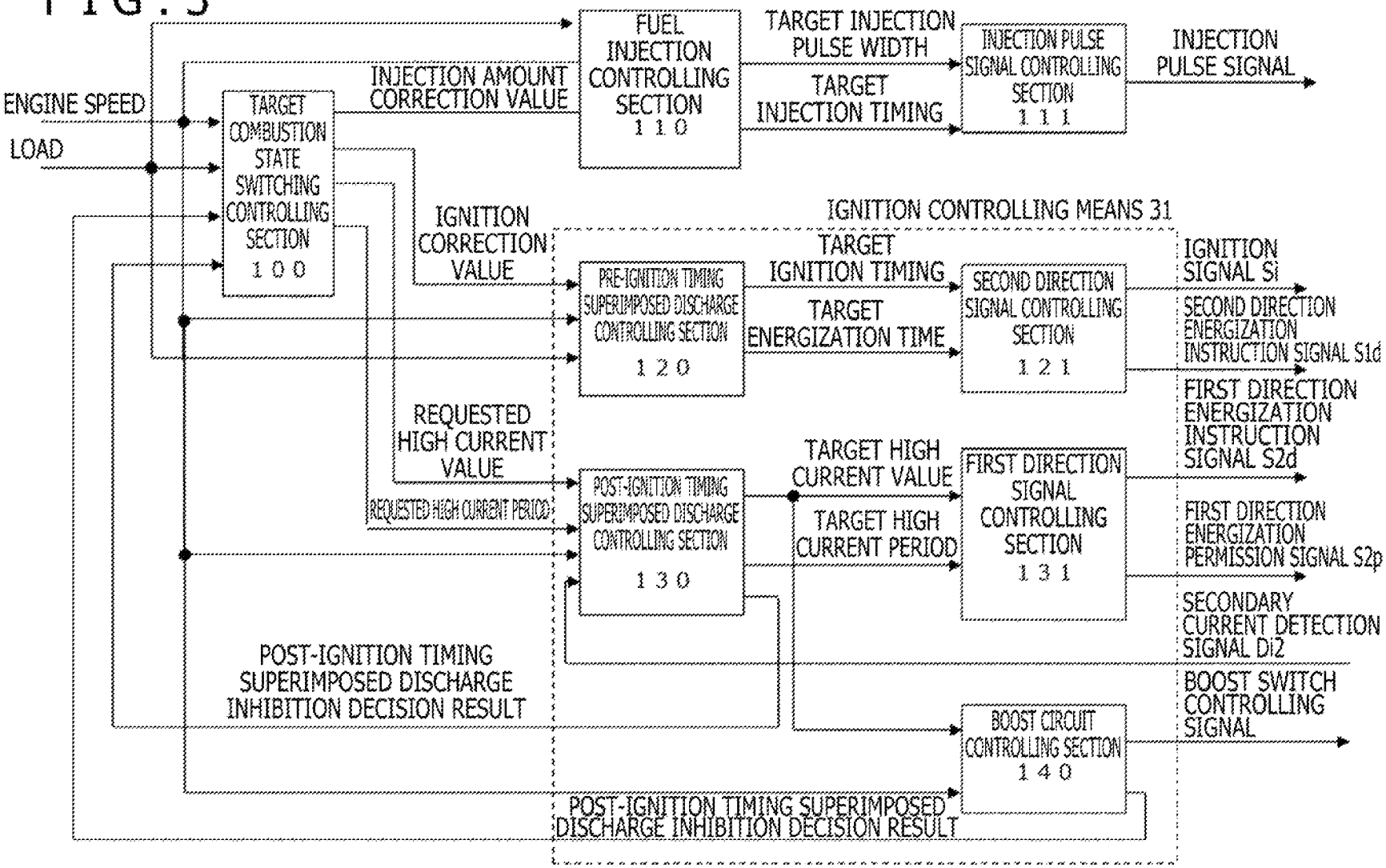
FIG. 5 is a view illustrating an example of a functional configuration of an internal combustion engine driving controlling device.

FIG. 5 is a view illustrating an example of a functional configuration of the internal combustion engine driving controlling device 3.

The internal combustion engine driving controlling device 3 includes a target combustion state switching controlling section 100, a fuel injection controlling section 110, an injection pulse signal controlling section 111, an pre-ignition timing superimposed discharge controlling section 120, a second direction signal controlling section 121, an post-ignition timing superimposed discharge controlling section 130, a first direction signal controlling section 131, and a boost circuit controlling section 140.

The target combustion state switching controlling section 100 selects a combustion state of the internal combustion engine in response to the speed and the load state of the internal combustion engine (engine) and calculates an injection amount correction value, an ignition correction value, a requested high current value, and a requested high current period.

The fuel injection controlling section 110 calculates a target injection pulse width and a target injection timing in response to the speed and the load state of the internal combustion engine (engine) and calculates a target injection pulse width corrected for the target injection pulse width with the injection amount correction value.

The injection pulse signal controlling section 111 outputs an injection pulse signal calculated on the basis of the target injection pulse width and the target injection timing to a fuel injection valve (not depicted).

The ignition controlling means 31 is configured from the pre-ignition timing superimposed discharge controlling section 120, the second direction signal controlling section 121, the post-ignition timing superimposed discharge controlling section 130, the first direction signal controlling section 131, and the boost circuit controlling section 140.

The pre-ignition timing superimposed discharge controlling section 120 calculates a basic injection timing and a target energization time period in response to the speed and the load state of the internal combustion engine (engine) and calculates a target injection timing corrected for the basic ignition timing with the ignition timing correction value.

The second direction signal control 121 outputs an ignition signal Si and a second direction energization instruction signal S1*d* calculated on the basis of the target ignition timing and the target energization time period to the sub primary coil magnetic flux generation state switching unit 5 described hereinabove.

The post-ignition timing superimposed discharge controlling section 130 calculates a provisional target high current value from the requested high current value and calculates a first provisional target high current period T532 (refer to FIG. 4) from the requested high current period.

Here, the ignition controlling means 31 performs abnormality decision in order to prevent failure of the sub primary coil magnetic flux generation state switching unit 5 or the ignition coil unit 10 by the current I1*b*2 in the first direction and the current I1*b*1 in the second direction, which flow simultaneously through the sub primary coil 111*b*.

In the embodiment, the ignition controlling means 31 detects partial or full overlap of an ON period T542 of the fourth sub switch element 54 that supplies the power supply voltage VB+ to the second terminal 111*b*2 in order to energize the sub primary coil 111*b* with the current I1*b*2 in the first direction and an ON period T521 of the second sub switch element 52 that supplies the power supply voltage VB+ to the first terminal 111*b*1 in order to energize the sub primary coil 111*b* with the current I1*b*1 in the second direction. If such overlap is detected, then the ignition controlling means 31 makes an abnormality decision.

In such a way, in the case of an ignition device that includes a plurality of primary coils of a main primary coil 111*a* and a sub primary coil 111*b* and the energization direction of the sub primary coil 111*b* is switchably controlled to perform post-ignition timing superimposed discharge control, the ignition device includes a plurality of switch elements for switching the energization direction. Therefore, by deciding whether or not there is an overlap of ON periods of a plurality of switch elements for supplying a power supply voltage from among the switch elements, energization abnormality of the sub primary coil 111*b* can be detected.

Further, the ignition controlling means 31 performs abnormality decision for preventing failure of a switch element on the downstream side by through-current (short-circuiting) of the two switch elements positioned on the upstream side and the downstream side in the flowing direction of current in the electric circuit diagram.

In the embodiment, in order to prevent failure of the third sub switch element 53 (downstream side switch element) by through-current (short-circuiting) of the second sub switch element 52 (switch element on the upstream side) and the third sub switch element 53 (switch element on the downstream side), the ignition controlling means 31 compares the first provisional target high current period T532 that is an ON period of the third sub switch element 53 and the period T523 after the second sub switch element 52 turns a predetermined cylinder (for example, the first cylinder) from ON to OFF until it turns a next cylinder (for example, the second cylinder) ON with each other as depicted in FIG. 4. Then, if T532 T523, the ignition controlling means 31 makes abnormality decision.

Further, as depicted in FIG. 4, in order to prevent failure of the fourth sub switch element 54 (switch element on the downstream side) by through-current (short-circuiting) of the fourth sub switch element 54 (switch element on the upstream side) and the first sub switch element 51 (switch element on the downstream side), the ignition controlling means 31 compares the second provisional target high current period T542 that is an ON period of the fourth switch element 54 and the period T513 after the first sub switch element 51 turns a predetermined cylinder (for example, the first cylinder) energization ON to OFF until it turns a next cylinder (for example, the second cylinder) ON with each other. Then, if T542 T513, the ignition controlling means 31 makes abnormality decision.

Further, in the case where the ignition controlling means 31 makes abnormality decision, in order to prevent generation of through-current (short-circuiting) by simultaneous turning ON of a switch element on the upstream side and a switch element on the downstream side, the ignition controlling means 31 restricts the ON period of at least one of the switch element on the upstream side and the switch element on the downstream side to a shorter period.

For example, in the embodiment, the ignition controlling means 31 restricts, to a shorter period, at least one of the period T513 after the first sub switch (one of 51*a* to 51*d*) of a predetermined cylinder (for example, the first cylinder) turns from ON to OFF until a sub switch (one of 51*a* to 51*d*) of a next cylinder (for example, the second cylinder) turns ON and the first provisional target high current period T542 that is an ON period of the first cylinder of the fourth sub switch element 54.

Further, in the present embodiment, the ignition controlling means 31 restricts, to a shorter period, at least one of the period T523 after the second sub switch element 52 turns a predetermined cylinder (for example, the first cylinder) from energization ON to OFF until it turns ON a next cylinder (for example, the second cylinder) and the first provisional target high current period T532 that is an ON period of the third sub switch element 53.

For example, the ignition controlling means 31 restricts the first provisional target high current period T542 that is an ON period of the first cylinder of the fourth sub switch element 54 or the first provisional target high current period T532 that is an ON period of the third sub switch element 53. By this, the ignition controlling means 31 can prevent generation of through-current easily only by calculation.

Further, in the case where the ignition controlling means 31 sets the second provisional target high current period T542 to a maximum value set in advance and decides that normal post-ignition timing superimposed discharge is not possible, the target combustion state switching controlling section 100 switches the combustion state such that combustion deterioration is prevented. In particular, the target combustion state switching controlling section 100 switches the operation state of the internal combustion engine from operation with a high air fuel ratio by lean burn to operation with an ordinary air fuel ratio. Alternatively, the target combustion state switching controlling section 100 switches the operation state of the internal combustion engine from operation by high EGR combustion to operation that does not perform high EGR combustion.

Here, the period T513 after the first sub switch (one of 51*a* to 51*d*) of a predetermined cylinder (for example, the first cylinder) turns from ON to OFF until the first sub switch (one of 51*a* to 51*d*) of a next cylinder (for example, the second cylinder) turns ON and the period T523 after the second sub switch element 52 turns a predetermined cylinder (for example, the first cylinder) from energization ON to OFF until it turns ON a next cylinder (for example, the second cylinder) are values when a period in which the first sub switch (one of 51*a* to 51*d*) of a predetermined cylinder (for example, the first cylinder) and the second sub switch element 52 of the cylinder turn from OFF to ON, that is, a target energization time period, is subtracted from an interval between cylinders calculated from the speed of the internal combustion engine (engine), and can be determined by ignition timings. Accordingly, abnormality decision is carried out from ignition timings.

Further, as depicted in FIG. 3, in the case where energization abnormality is detected, the ignition controlling means 31 may decrease the energization time period of the sub primary coil 111*b* in the second direction and increase the energization voltage (current value) by an amount corresponding to the decreased amount of the energization time period such that the discharge energy (current area depicted in FIG. 3) may be equal (refer to a broken line in FIG. 3).

If the ignition controlling means 31 is configured in such a manner, then it can prevent energization abnormality while assuring the ignitability of the ignition plug 2.

Then, the post-ignition timing superimposed discharge controlling section 130 calculates the target high current value such that it is feedback (Feed Back: FB) controlled by the second provisional target high current value and the secondary current detection signal.

The first direction signal controlling section 131 outputs a first direction energization instruction signal S2*d* and a first direction energization permission signal S2*p* based on the target high current value and the target high current period.

The boost circuit controlling section 140 starts PWM (Pulse Width Modulation) control before a predetermined time period set in advance to a control start timing at the post-ignition timing superimposed discharge controlling section 130 and outputs a boost switch controlling signal to the boost circuit 7 (boost switch control connection portion 71).

Here, although the predetermined time period set in advance is set depending upon a target high current value, in the case where the speed of the internal combustion engine (engine) is high, it is difficult to assure the predetermined time period. Therefore, the predetermined time period set in advance (time period T722 depicted in FIG. 4) and the interval between cylinders calculated from the speed of the internal combustion engine (time period T721 depicted in FIG. 4) are compared with each other. Then, when T721<T722, the ignition controlling means 31 decides that normal post-ignition timing superimposed discharge is impossible, and the target combustion state switching controlling section 100 switches the combustion state such that combustion deterioration is prevented. The method for switching the combustion state is similar to that described above, and means for inhibiting lean burn or high EGR combustion is available.

The configuration of the ignition controlling means 31 described hereinabove for detecting energization abnormality in that current in the first direction and current in the second direction overlap with each other and flow to the sub primary coil 111*b* and the configuration for comparing an ON period or an OFF period of a switch element on the upstream side (for example, the fourth sub switch element 54 or the second sub switch element 52) (for example, the ON period T542 of the fourth sub switch element 54 or the OFF period T523 of the second sub switch element 52) and an ON period or an OFF period of a switch element on the downstream side (for example, the first sub switch element 51 or the third sub switch element 53) (for example, the OFF period T513 of the fourth sub switch element 54 or the ON period T532 of the third sub switch element 53) and for deciding energization abnormality of the switch element correspond to the abnormality detection section in the present invention.

Further, the configuration for switching, when energization abnormality is detected, the operation state of the internal combustion engine by the ignition controlling means 31 (internal combustion engine driving controlling device 3) corresponds to the control device of the present invention.

As described above, the embodiment is (1) an internal combustion engine ignition device 1 that includes an ignition coil 11 and an ignition plug 2 that performs discharge with secondary current I2 generated in the ignition coil 11, in which the ignition coil 11 includes a primary coil 111 including a main primary coil 111*a* and a sub primary coil 111*b* and a secondary coil 112 that generates secondary current I2 in response to a voltage variation generated in the primary coil 111, the internal combustion engine ignition device 1 includes:

a main switch element 12 (main switch) that performs energization (current I1*b*2 in the first direction) of the main primary coil 111*a* in a first direction (clockwise direction in FIG. 1)/deenergization;

a sub primary coil magnetic flux generation state switching unit 5 (sub primary coil magnetic flux generation state switching section) capable of switching between a forward direction magnetic flux generation state in which energization of the sub primary coil 111*b* in the first direction is performed and an opposite direction magnetic flux generation state in which energization of the sub primary coil 111*b* in a second direction is performed; and an abnormality detection section that detects energization abnormality to the sub primary coil 111*b* by the sub primary coil magnetic flux generation state switching unit 5, and the abnormality detection section is configured so as to detect energization abnormality to the sub primary coil 111*b* on the basis of overlap between energization (current I1*b*2 in the first direction) of the sub primary coil 111*b* in the first direction and energization (current I1*b*1 in the second direction) of the sub primary coil 111*b* in the second direction.

With this configuration, in the internal combustion engine ignition device 1, since energization abnormality is detected on the basis of an overlap of the energization in the first direction and the energization in the second direction of the sub primary coil 111*b*, energization abnormality of the switch element of the internal combustion engine ignition device 1 can be detected appropriately.

(2) Further, the sub primary coil magnetic flux generation state switching unit 5 is configured such that an energization time period in the second direction is adjusted on the basis of detection of energization abnormality of the sub primary coil 111*b* by the abnormality detection section such that the energization I1*b*2 in the first direction and the energization I1*b*1 in the second direction of the sub primary coil 111*b* do not overlap with each other.

With this configuration, in the internal combustion engine ignition device 1, since the fourth sub switch element 54 on the upstream side that performs ON/OFF switching of energization of the sub primary coil 111*b* in the first direction and the second sub switch element 52 on the upstream side that performs ON/OFF switching of energization in the second direction of the sub primary coil 111*b* are turned ON simultaneously, it can be prevented that through-current flows through the third sub switch element 53 on the downstream side corresponding to the fourth sub switch element 54 on the upstream side or the first sub switch element 51 on the downstream side corresponding to the second sub switch element 52 on the upstream side to destroy the switch element on the downstream side.

(3) Further, the sub primary coil magnetic flux generation state switching unit 5 is configured so as to be operable on the basis of detection of energization abnormality of the sub primary coil 111 by the abnormality detection section to adjust the energization time period in the second direction such that the energization I1*b*2 in the first direction and the energization I1*b*1 in the second direction of the sub primary coil 111*b* do not overlap with each other and adjust the energization voltage in the second direction such that discharge energy generated in an ignition plug 2 becomes target discharge energy.

With this configuration, in the internal combustion engine ignition device 1, in the case where energization abnormality of the sub primary coil 111*b* is detected, it is possible to reduce the energization time period of the energization in the second direction to avoid the energization abnormality and increase the energization voltage such that the discharge energy of the ignition plug 2 does not decrease by an amount corresponding to the reduction amount of the energization time period thereby to assure ignitability of the ignition plug.

(4) It is to be noted that, while the embodiment described above exemplifies a case in which the energization time period and the energization voltage in the second direction of the sub primary coil 111*b* on the basis of detection of energization abnormality of the sub primary coil 111*b*, this is not restrictive if it is possible to prevent the current I1*b*2 in the first direction and the energization I1*b*1 in the second direction of the sub primary coil 111*b* from overlapping with each other.

For example, the sub primary coil magnetic flux generation state switching unit 5 may be configured such that, on the basis of detection of energization abnormality of the sub primary coil 111*b* by the abnormality detection section, the energization time period in the first direction is adjusted such that the energization I1*b*2 in the first direction and the energization I1*b*1 in the second direction of the sub primary coil 111*b* do not overlap with each other and the energization voltage in the first direction is adjusted such that the discharge energy generated by the ignition plug 2 becomes target discharge energy.

Also with this configuration, in the internal combustion engine ignition device 1, in the case where energization abnormality of the sub primary coil 111*b* is detected, it is possible to reduce the energization time period of the energization in the first direction to avoid the energization abnormality and increase the energization voltage such that the discharge energy of the ignition plug 2 does not decrease by an amount corresponding to the reduction amount of the energization time period thereby to assure ignitability of the ignition plug.

(5) Further, the internal combustion engine ignition device 1 includes a boost circuit 7 (boost device) that boosts the energization voltage in the second direction upon the energization I1*b*1 in the second direction of the sub primary coil 111*b* by the sub primary coil magnetic flux generation state switching unit 5, and the abnormality detection section is configured so as to detect energization abnormality to the sub primary coil 111*b* on the basis of overlap of the energization time period of the sub primary coil 111*b* in the first direction by the sub primary coil magnetic flux generation state switching unit 5 and a charge period of the boost circuit 7.

With this configuration, if the charge period of the boost circuit 7 (the ON period T722 of the boost switch 72 depicted in FIG. 4) and the energization time period in the first direction (ON period of the first direction energization instruction signal S2*d* depicted in FIG. 4) overlap with each other, then charge of the boost circuit 7 cannot be performed and the charge amount becomes insufficient. The abnormality detection section prevents charge of the boost circuit 7 from becoming insufficient by detecting overlap of the charge period of the boost circuit 7 and the energization time period of the sub primary coil 111*b* in the first direction, and the ignition coil 11 can supply sufficient discharge energy to the ignition plug.

(6) Further, the abnormality detection section is configured so as to detect energization abnormality to the sub primary coil in the case where the abnormality detection section decides that a charge interval (interval T721 of the boost switch 72 depicted in FIG. 4) of the boost circuit 7 between cylinders (not depicted) of an internal combustion engine is shorter than the charge period (interval T722 of the boost switch 72 depicted in FIG. 4) of the boost circuit 7 at a predetermined cylinder (not depicted).

In the case where the internal combustion engine rotates at a high speed, the charge interval (interval T721 in FIG. 4) of the boost circuit 7 between the cylinders is short. As a result, if it is tried to sufficiently assure a charge period of the boost circuit 7 at a predetermined cylinder (period T722 in FIG. 4), then the charge period overlaps with a charge period of the boost circuit 7 of a next cylinder, resulting in energization abnormality.

With this configuration, energization abnormality by the boost circuit 7 between the cylinders can be detected accurately on the basis of overlap of a charge interval of the boost circuit 7 between the cylinders and a charge period at a predetermined cylinder.

(7) Further, the internal combustion engine ignition device 1 is configured such that the fourth sub switch element 54 connected to a power supply voltage VB+ side for performing energization/deenergization in the first direction is connected to one end (111*b*2) of the sub primary coil 111*b* while a third sub switch element 53 connected to a ground GND side is connected to the other end (111*b*1) of the sub primary coil 111*b*, and to the other end (111*b*1) of the sub primary coil 111*b*, the second sub switch element 52 connected to a power supply voltage VB+ side for performing energization/deenergization in the second direction is connected while, to one end (111*b*2) of the sub primary coil 111*b*, the first sub switch element 51 connected to the ground GND side is connected, and the abnormality detection section detects energization abnormality of the sub primary coil 111*b* on the basis of short-circuiting between the fourth sub switch element 54 connected to the power supply voltage VB+ side of the energization in the first direction and the first sub switch element 51 connected to the ground GND side of the energization in the second direction, and detects energization abnormality of the sub primary coil 111*b* on the basis of short-circuiting between the second sub switch element 52 connected to the power supply voltage VB+ side of the energization in the second direction and the third sub switch element 53 connected to the ground GND side of the energization in the first direction.

With this configuration, since the abnormality detection section can detect energization (short-circuiting) abnormality between the switch element on the power supply voltage VB+ side of the sub primary coil 111*b* and the switch element on the ground GND side of the sub primary coil 111*b*, failure of the switch elements by short-circuiting can be prevented.

(8) In an internal combustion engine driving controlling device 3 having a control device for controlling an operation state of an internal combustion engine in which the internal combustion engine ignition device 1 according any one of (1) to (7) described above is provided, the control device is configured so as to switch an operation state of the internal combustion engine (not depicted) to control at a low air fuel ratio on the basis of detection of energization abnormality of the sub primary coil 111*b* by the abnormality detection section.

With the configuration, the internal combustion engine driving controlling device 3 can perform operation of the internal combustion engine appropriately by switching, in response to energization abnormality of the sub primary coil 111*b*, the operation state of the internal combustion engine from operation by control at a high air fuel ratio (for example, operation by lean burn control) to a low air fuel ratio (operation with an ordinary air fuel ratio).

(9) Further, the internal combustion engine is configured as a four-cycle engine having a plurality of cylinders.

In a four cycle type engine, as the speed of rotation increases, the possibility that the energization abnormality described hereinabove may occur increases. Therefore, the internal combustion engine driving controlling device 3 can perform operation of the internal combustion engine more appropriately by switching, in the case where abnormality is detected by the abnormality detection section, the operation of the internal combustion engine from operation by control at a high air fuel ratio (for example, operation by lean burn control) to a low air fuel ratio (operation at an ordinary air fuel ratio).

(10) Further, the control device is configured so as to switch, in the case where it is decided that a charge interval (interval T721 of the boost switch 72 depicted in FIG. 4) of the boost circuit 7 in each cylinder of the internal combustion engine is shorter than a charge period (ON period T722 of the boost switch 72 depicted in FIG. 4) of the boost circuit 7 at a predetermined cylinder, the operation state of the internal combustion engine to control with a low air fuel ratio.

With this configuration, in the case where it cannot be avoided to reduce the charge period of the boost circuit 7 and the boost of the sub primary coil 111*b* by the boost circuit 7 cannot be performed sufficiently, operation of the internal combustion engine can be performed more appropriately by switching the operation state of the internal combustion engine from operation by control at a high air fuel ratio (for example, operation by lean burn control) to a low air fuel ratio (operation with an ordinary air fuel ratio).

Although an example of the embodiments of the present invention has been described, the present invention may be a combination of all of the embodiments described above, and it is preferable if two or more of the embodiments are combined optionally.

Further, the present invention is not limited to what includes all configurations of the embodiments described hereinabove, and part of the configurations of the embodiments described hereinabove may be replaced into a configuration of some other embodiment or a configuration of the embodiments described hereinabove may be replaced to a configuration of some other embodiment.

Further, some configuration of the embodiments described hereinabove may be added to, deleted from, or replaced with a configuration of some other embodiment.

DESCRIPTION OF REFERENCE CHARACTERS

1: Internal combustion engine ignition device
2: Ignition plug
3: Internal combustion engine driving controlling device 31: Ignition controlling means
4: DC power supply (battery)
5: Sub primary coil magnetic flux generation state switching unit
7: Boost circuit
10: Ignition coil unit
11: Ignition coil
111*a*: Main primary coil
111*b*: Sub primary coil
112: Secondary coil
113: Center core
12: Main switch element
51: First sub switch element

52: Second sub switch element
53: Third sub switch element
54: fourth sub switch element

The invention claimed is:

1. An internal combustion engine ignition device including an ignition coil and an ignition plug that performs discharge with current generated in the ignition coil, the ignition coil including a primary coil including a main primary coil and a sub primary coil and a secondary coil that generates a voltage according to a current variation generated in the primary coil, the internal combustion engine ignition device comprising:

a main switch that performs energization/deenergization of the main primary coil in a first direction;

a sub primary coil magnetic flux generation state switching section that switches between a forward direction magnetic flux generation state in which energization of the sub primary coil in the first direction is performed and an opposite direction magnetic flux generation state in which energization of the sub primary coil in a second direction is performed; and an abnormality detection section that detects energization abnormality to the sub primary coil by the sub primary coil magnetic flux generation state switching section, wherein the abnormality detection section detects energization abnormality to the sub primary coil on a basis of overlap between energization states of a plurality of switch elements in the first direction and in the second direction.

2. The internal combustion engine ignition device according to claim 1, wherein the sub primary coil magnetic flux generation state switching section adjusts an energization time period in the second direction on a basis of detection of energization abnormality of the sub primary coil by the abnormality detection section such that the energization in the first direction and the energization in the second direction of the sub primary coil do not overlap with each other.

3. The internal combustion engine ignition device according to claim 2, wherein the sub primary coil magnetic flux generation state switching section is operable on the basis of detection of energization abnormality of the sub primary coil by the abnormality detection section to adjust the energization time period in the second direction such that the energization in the first direction and the energization in the second direction of the sub primary coil do not overlap with each other and adjust the energization voltage in the second direction such that discharge energy generated in the ignition plug becomes target discharge energy.

4. The internal combustion engine ignition device according to claim 2, wherein the sub primary coil magnetic flux generation state switching section is operable on the basis of detection of energization abnormality of the sub primary coil by the abnormality detection section to the energization time period in the first direction such that the energization in the first direction and the energization in the second direction of the sub primary coil do not overlap with each other and adjust the energization voltage in the first direction such that the discharge energy generated by the ignition plug becomes target discharge energy.

5. The internal combustion engine ignition device according to claim 1, further comprising:

a boost device that boosts the energization voltage in the second direction upon the energization in the second direction of the sub primary coil by the sub primary coil magnetic flux generation state switching section, wherein the abnormality detection section detects energization abnormality to the sub primary coil on a basis of overlap of the energization time period of the sub primary coil in the first direction by the sub primary coil magnetic flux generation state switching section and a charge period of the boost device.

6. The internal combustion engine ignition device according to claim 5, wherein the abnormality detection section detects energization abnormality to the sub primary coil in a case where the abnormality detection section decides that a charge interval of the boost device between cylinders of the internal combustion engine is shorter than the charge period of the boost device at a predetermined cylinder.

7. The internal combustion engine ignition device according to claim 1, wherein a fourth sub switch connected to a power supply side for performing energization/deenergization in the first direction is connected to one end of the sub primary coil while a third sub switch connected to a ground side is connected to the other end of the sub primary coil, and to the other end of the sub primary coil, a second sub switch connected to a power supply side for performing energization/deenergization in the second direction is connected while, to one end of the sub primary coil, a first sub switch connected to the ground side is connected, and the abnormality detection section detects energization abnormality of the sub primary coil on a basis of short-circuiting between the fourth sub switch connected to the power supply side of the energization in the first direction and the first sub switch connected to the ground side of the energization in the second direction, and detects energization abnormality of the sub primary coil on a basis of short-circuiting between the second sub switch connected to the power supply side of the energization in the second direction and the third sub switch connected to the ground side of the energization in the first direction.

8. An internal combustion engine controlling device comprising:

a control device for controlling an operation state of an internal combustion engine that includes the internal combustion engine ignition device according to claim 1, wherein the control device switches the operation state of the internal combustion engine to control at a low air fuel ratio on a basis of detection of energization abnormality of the sub primary coil by the abnormality detection section.

9. The internal combustion engine controlling device according to claim 8, wherein the internal combustion engine is a four-cycle engine having a plurality of cylinders.

10. The internal combustion engine controlling device according to claim 9, wherein the control device switches, in a case where control device decides that a charge interval of the boost device in each cylinder of the internal combustion engine is shorter than a charge period of the boost device at a predetermined cylinder, the operation state of the internal combustion engine to control with a low air fuel ratio.

* * * * *